US005647014A

United States Patent [19]

Geisenberger

[11] Patent Number: 5,647,014

[45] Date of Patent: Jul. 8, 1997

[54] VOICE COIL SUPPORT FOR LOUDSPEAKER

[75] Inventor: Stefan Geisenberger, Straubing, Germany

[73] Assignee: Nokia Technology GmbH, Pforzheim, Germany

[21] Appl. No.: 448,256

[22] Filed: May 23, 1995

[30] Foreign Application Priority Data

Jun. 1, 1994 [DE] Germany ..... 44 19 250.9

[51] Int. Cl.[6] ..... H04R 25/00

[52] U.S. Cl. ..... 381/194; 381/199

[58] Field of Search ..... 381/199, 194, 381/192, 195

[56] References Cited

U.S. PATENT DOCUMENTS

| | | | |
|---|---|---|---|
| 2,010,529 | 8/1935 | Van Urk | 381/194 |
| 2,538,691 | 7/1951 | Kim | 381/194 |
| 4,118,605 | 10/1978 | Kobayashi . | |
| 4,567,327 | 1/1986 | Goossens et al. | 179/115.5 |
| 4,868,882 | 9/1989 | Ziegenberg et al. | 381/200 |
| 5,027,412 | 6/1991 | Hayashi et al. . | |

FOREIGN PATENT DOCUMENTS

| | | | |
|---|---|---|---|
| 359572 | 11/1980 | Australia . | |
| 709374 | 7/1941 | Germany . | |
| 1174364 | 7/1964 | Germany . | |
| 3302592 | 8/1983 | Germany . | |
| 3620889 | 12/1987 | Germany . | |
| 3730305 | 3/1989 | Germany . | |
| 0279697 | 11/1988 | Japan | 381/199 |
| 406303697 | 10/1994 | Japan | 381/199 |
| 565414 | 7/1977 | U.S.S.R. . | |
| 2114855 | 8/1983 | United Kingdom | 381/202 |

OTHER PUBLICATIONS

*Patent Abstracts of Japan*, vol. 9, No. 110 (E–314), May 15, 1985 & JP–A–60001999 (Matsushita Denki Sangyo KK).

*Primary Examiner*—Sinh Tran

*Attorney, Agent, or Firm*—Ware, Fressola, Van Der Sluys & Adolphson LLP

[57] ABSTRACT

According to the state of the art, the voice coil (12) of a loudspeaker is connected to the voice coil support (10) in such a way, that first the coil wire, which is surrounded by a self-bonding material, is wound around the outside jacket (14) of the voice coil support (10), and then is baked. However, under mechanical load, such a connection is only temperature-stable to about 200 degrees Celsius. It is therefore the task of the invention to present a connection between voice coil (12) and voice coil support (10), which is also temperature-stable above 200 degrees Celsius. This task is fulfilled by the invention, in that holding elements (13) are placed around the outside jacket of the voice coil (12), which act against any radial and/or axial change in position of the individual winding wires of voice coil (12). These holding elements (13) can be (ultrasonically) welded to the voice coil support (10), or be attached to the inside sleeve (18) of the voice coil support (10) by simple bending.

11 Claims, 4 Drawing Sheets

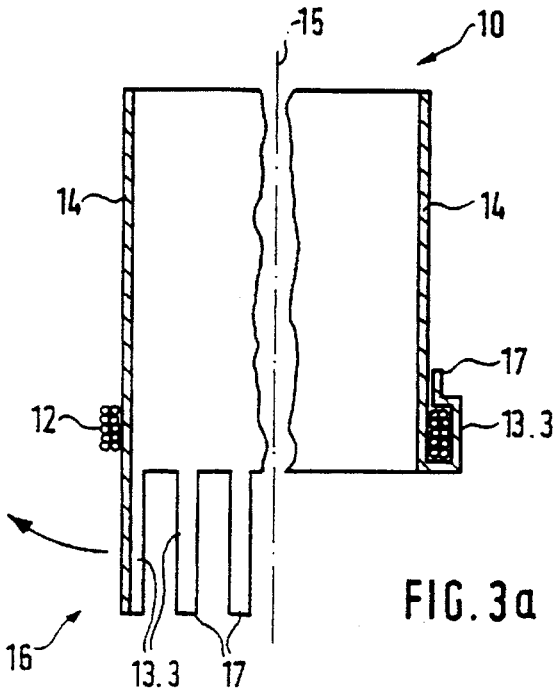
FIG. 3a
FIG. 3b
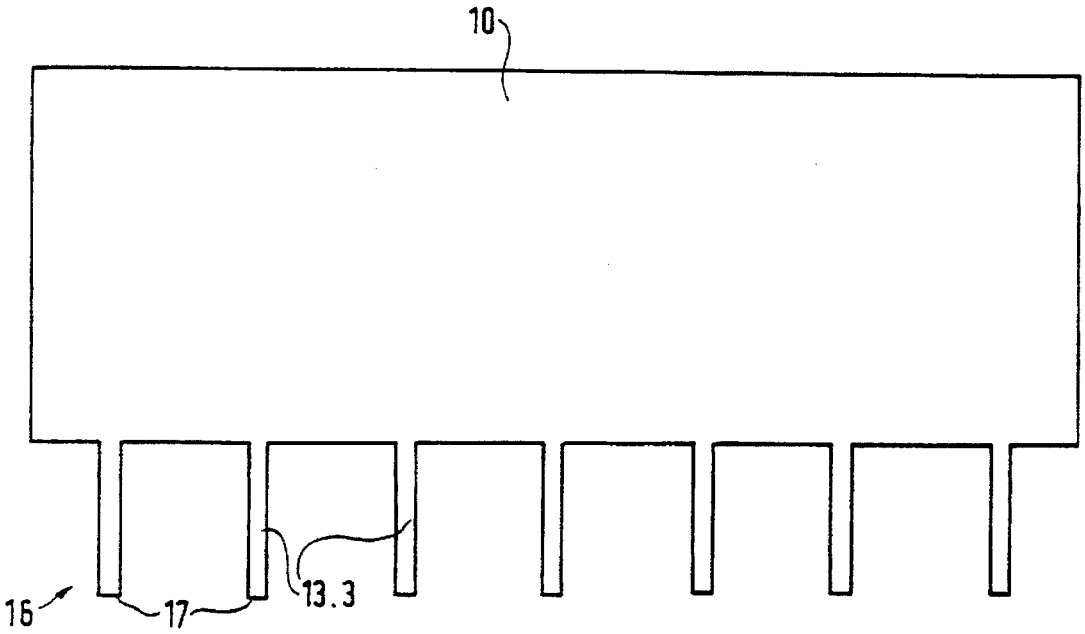

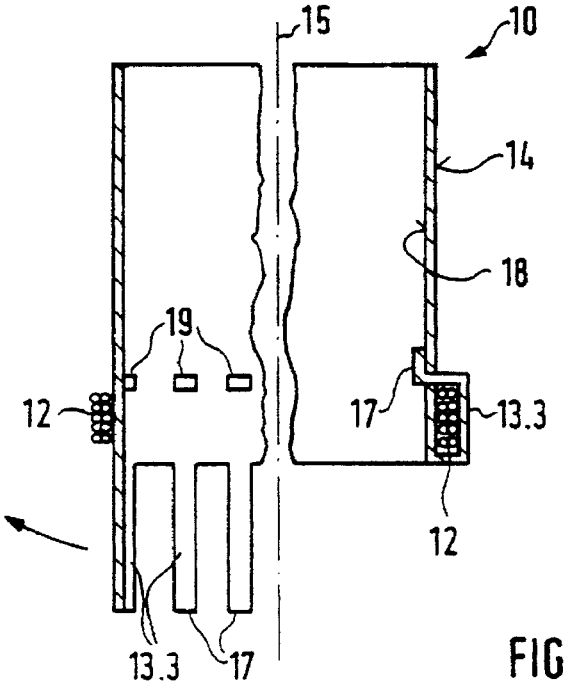
FIG.4a
FIG.4b
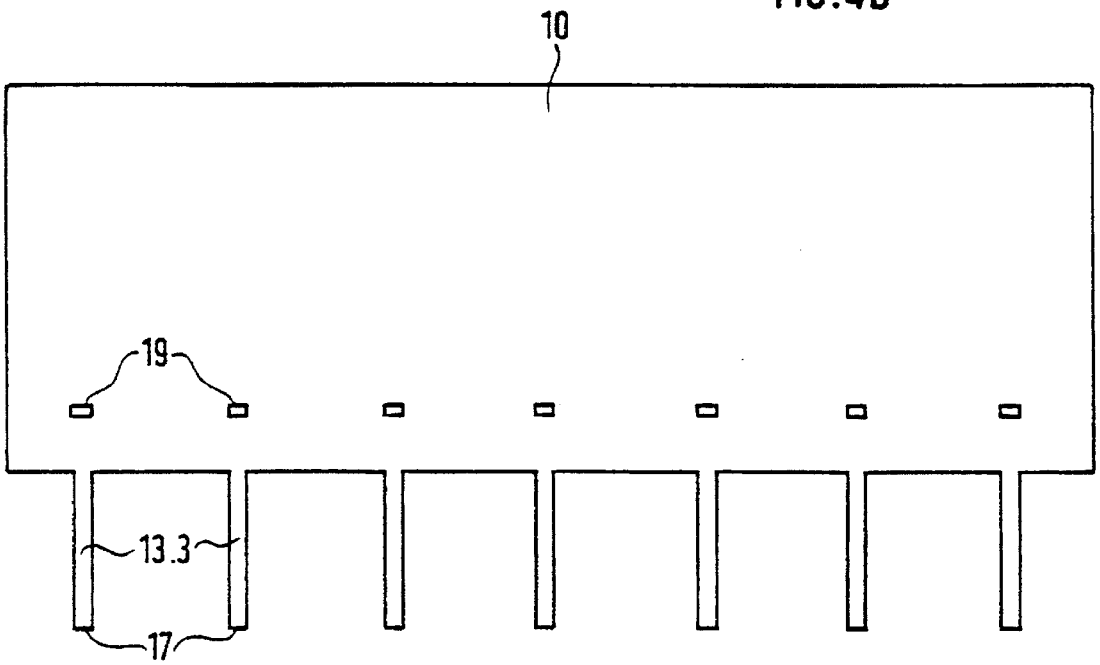

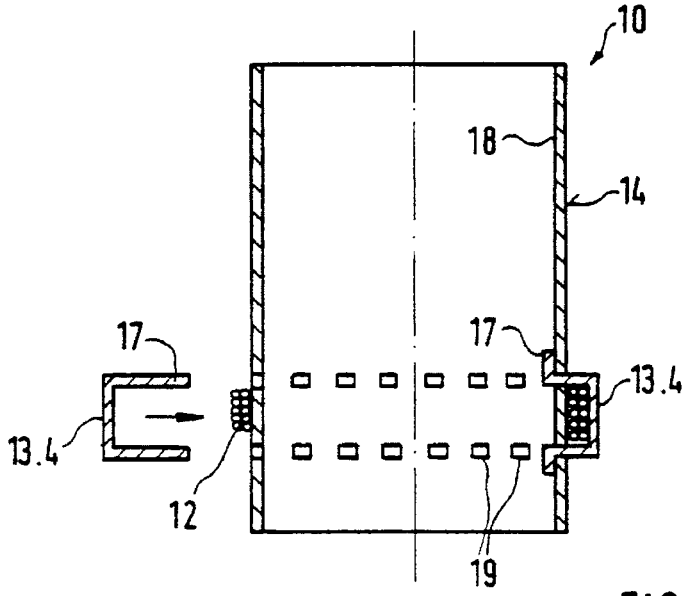
FIG. 5a
FIG. 5b
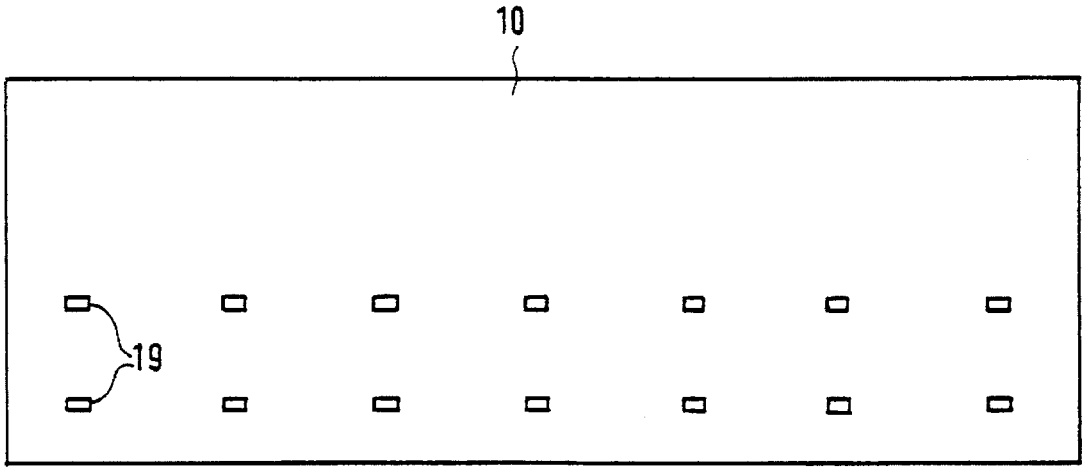

VOICE COIL SUPPORT FOR LOUDSPEAKER

TECHNICAL FIELD

The invention concerns the construction of voice coil supports for loudspeakers, particularly connecting the voice coil to the voice coil support.

BACKGROUND OF THE INVENTION

In the state of the art, the voice coil is connected to the voice coil support in such a way, that the coil wire, which is coated with a self-bonding material is wound around the tube-shaped voice coil support, and the winding is then baked to the voice coil support in a temperature procedure. With this type of connection the jacket surface of the voice coil support, around which the coil wire is wound, is usually also coated with self-bonding material.

Under mechanical stress, such connections are only effective to about 200 degrees Celsius. At higher temperatures, individual windings separate and wire breaks occur.

It is therefore the task of the invention to create a connection between voice coil and voice coil support, which provides durable operation even at temperatures above 200 degrees Celsius.

SUMMARY OF THE INVENTION

If holding elements are used which extend at least in the direction of the loudspeaker axis, and which are placed against the side of the voice coil that faces away from the voice coil support, the voice coil wires are prevented from detaching themselves in the radial direction. In addition, if the holding elements are also placed in areas that extend transversely to the loudspeaker axis, any wire detachment in the direction of the loudspeaker axis is also prevented. It should be pointed out in this connection that the latter effect of the holding elements can also be achieved by a special shape of the voice coil support.

If the holding elements and the voice coil support are constructed in one piece, the safeguard of the voice coil that is provided by the holding elements is especially simple to achieve. The bracket-shaped form of the holding elements has the advantage that it achieves its holding function with respect to the voice coil by simple bending.

A particularly simple connection of holding elements and voice coil support is created, if the holding elements and the voice coil support are made of an ultrasonically weldable material, because in that case the connection of holding elements and voice coil support can at least be partially made by ultrasonic welding.

A purely mechanical connection of holding elements and voice coil support is realized if, according to claim 4, the respective free ends of the holding elements formed on the edge of the voice coil support, penetrate into openings in the voice coil support, and are bent inside the voice coil support.

BRIEF DESCRIPTION OF THE DRAWINGS

FIGS. 3*a* and 3*b* are respectively another illustration of FIG. 1 and an illustration of an unwinding of a voice coil support;

FIGS. 4*a* and 4*b* are respectively other illustrations of FIGS. 3*a* and 3*b;* and FIGS. 5*a* and 5*b* are respectively other illustrations of FIGS. 3*a* and 3*b*.

BEST MODE FOR CARRYING OUT THE INVENTION

The invention will now be explained in more detail by means of the figures.

Figure 1:
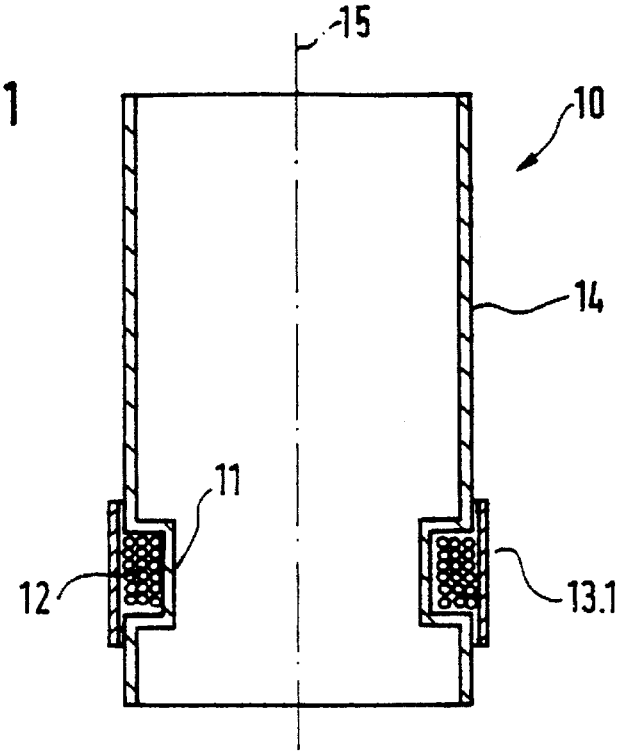
FIG. 1 is a cross section of a voice coil support.

FIG. 1 represents a cut through a tube-shaped voice coil support 10. The lower end of the voice coil support 10 has a circular groove 11, into which the voice coil 12 is wound. If the voice coil support 10 is equipped with such a groove 11, coating of the voice coil support 10 with self-bonding material can be omitted, since the groove 11 prevents the coil wire from sliding off during winding. The groove 11, which is completely filled with the windings of the voice coil 12, is closed off by a holding element 13 in the form of a band 13.1. However, this band 13.1 does not close off the groove 11 entirely. Rather, to reduce eddy current loss, the length of the band 13.1 is chosen so that, when the band 13.1 is placed around the outside jacket 14 of voice coil support 10 to close off groove 11, both ends of the band 13.1 do not touch each other, but a small space remains between the two ends of the encircling band 13.1 (not illustrated in FIG. 1).

The band 13.1 is connected to the outside jacket 14 of voice coil support 10, in the areas overlapped by the groove 11 in the direction of the loudspeaker axis. The side of band 13.1 that faces the voice coil 12 touches the windings of voice coil 12. For reasons of better visibility all the figures omit the depiction of a no-gap touching by the holding elements 13 of the voice coil support 10 and the voice coil 12.

A voice coil support 10 as shown in FIG. 1 is produced so that first the coil wire, which is equipped with insulation and enveloped by the self-bonding material, is wound into the groove 11 to form voice coil 12. Depending on the process, either the groove 11 is closed off by the band 13.1 and the voice coil is then baked, or it is first baked and the groove 11 is then closed off by the band 13.1. If the first alternative is used, a particularly stable unit of voice coil support 10 and voice coil 12 can be built if the voice coil support 10 is also coated with self-bonding material in the groove 11 and/or the band 13.1 area, on the side that faces voice coil 12.

In the configuration example illustrated in FIG. 1, the voice coil support 10 and the band 13.1 are made of aluminum and are joined together by the ultrasonic welding method.

Figure 2:
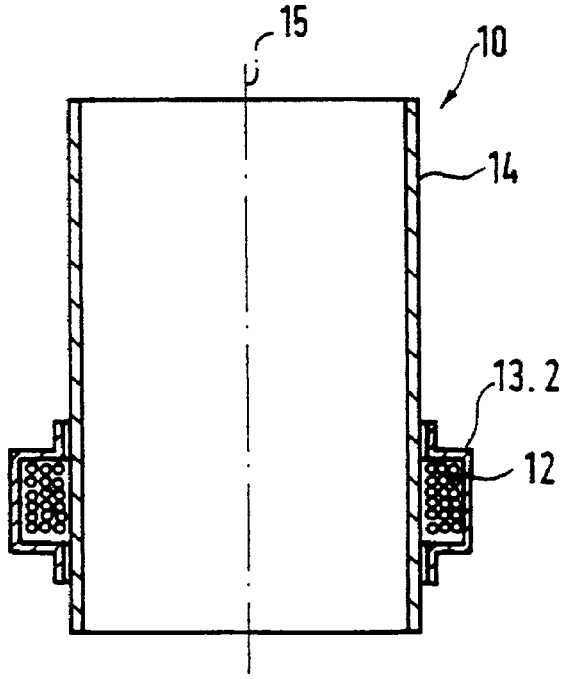
FIG. 2 is another illustration of FIG. 1.

The configuration example in FIG. 2 differs from the configuration example in FIG. 1 in that the voice coil support 10 has no circular groove, but voice coil 12, which is wound around the outside jacket 14, is enveloped by a holding element 13.2, which is essentially U-shaped and is connected to the outside jacket 14 of voice coil support 10. In this configuration example as well, the holding element 13.2, which boxes in the outside jacket 14 except for a narrow gap, and the voice coil support 10, are joined together by using the ultrasonic welding method.

FIG. 3*a* is a cross section of a voice coil support 10, where the voice coil 12 is wound around the outside jacket 14. The left side of the illustration in FIG. 3*a* shows that bracket-shaped holding elements 13.3 are formed on the free rim 16 of voice coil support 10. The latter is illustrated in more detail by unwinding the voice coil support 10 in FIG. 3*b*. To additionally join the voice coil 12 to these holding elements 13.3, the holding elements 13.3 are bent around the voice coil 12 in the direction of the arrow in FIG. 3*a*. After the bending process is completed, all holding elements 13.3 envelop the outside contours of voice coil 12. The free ends 17 of the bracket-shaped holding elements 13.3 are joined to the outside jacket 14 of voice coil support 10 in the above illustrated manner. A bent bracket-shaped holding element 13.3, which is joined to the outside jacket 14 of voice coil support 10, can be seen on the right side of FIG. 3*a*.

The welding of the free end 17 of the bracket-shaped holding elements 13.3 can be omitted, if the areas 17 of the bracket-shaped holding elements 13.3 on the outside jacket 14 are pressed by a surrounding ring (not illustrated) against the outside jacket 14 of the voice coil support 10.

The configuration example shown in conjunction with FIGS. 4*a* and 4*b* differ from those of FIGS. 3*a* and 3*b* in that the bracket-shaped holding elements 13.3 are connected to the inside sleeve 18 of voice coil support 10. To that end, the jacket surface of voice coil support 10 has openings 19, through which the free ends 17 of the bracket-shaped holding elements 13.3 pass before they are connected to the inside sleeve 18 of voice coil support 10. In the configuration example of FIG. 4*a*, the connection is achieved by bending the free end 17 of holding element 13.3 with the part that passes through the opening 19, in the direction of the loudspeaker axis 15. The latter is illustrated in the right half of FIG. 4*a* for a holding element 13.3.

In contrast to the illustrations in FIGS. 3*a* and 3*b* and 4*a* and 4*b*, in FIGS. 5*a* and 5*b* the holding elements 13.4 and the voice coil support 10 are not made in one piece. The voice coil support 10 contains a number of openings 19 arranged in two rows. The distance between the openings 19 in both rows corresponds approximately to the winding width of voice coil 12 on the voice coil support 10. The holding elements 13.4 are essentially U-shaped, as clearly depicted on the left side of FIG. 5*a*. If the voice coil 12 is formed on the outside jacket 14 of voice coil support 10, the holding elements 13.4 are moved over the voice coil support 10 in the direction of the arrow. Since the leg spacing of the U-shaped holding elements 13.4 corresponds to the spacing of the openings 19 in the direction of loudspeaker axis 15, they penetrate into the openings 19. As soon as the inside surfaces of holding elements 13.4 are placed against the outside contour of voice coil 12, the parts of the leg ends 17, which penetrate into the openings 19, are bent in the direction of loudspeaker axis 15, so that they touch the inside sleeve 18 of the voice coil support 10. The latter is illustrated on the right side of FIG. 5*a* for a holding element 13.4.

What is claimed is:

1. A voice coil arrangement for loudspeakers, having a voice coil support (10) and a voice coil (12), which is wound around the outside jacket (14) of the voice coil support (10), characterized in that a holding element (13.3) is provided, which is connected to the voice coil support (10), and which at least partially touches sides of the voice coil (12) that are not in direct contact with the voice coil support (10);

the holding element (13.3) and the voice coil support (10) are a one-piece construction;

the holding element (13.3) is bracket-shaped; and at least one free end (17) of the holding element (13.3) penetrates through an opening (19) in the voice coil support (10), to hold the voice coil (12) to the voice coil support (10), said at least one free end having a bent end on an inside (18) of the voice coil support (10).

2. A voice coil arrangement as in claim 1, characterized in that the one-piece construction of the holding element (13.3) and the voice coil support 10 is made of an ultrasonically weldable material, and the bent end of the holding element (13.3) is at least partially connected to the voice coil support 10 by ultrasonic welding.

3. A voice coil arrangement for loudspeakers, having a voice coil support (10) and a voice coil (12), which is wound around the outside jacket (14) of the voice coil support (10), characterized in that a holding element (13.4) is provided, which is connected to the voice coil support (10), and which at least partially touches sides of the voice coil (12) that are not in direct contact with the voice coil support (10); and at least one free end (17) of the holding element (13.4) penetrates through an opening (19) in the voice coil support (10), to connect the voice coil (12) to the voice coil support (10), said at least one free end having a bent end on an inside (18) of the voice coil support (10).

4. A voice coil arrangement as in claim 3, characterized in that the holding element (13.4) and the voice coil support 10 are made of an ultrasonically weldable material, and that the holding element (13.4) is at least partially connected to the bent end of the voice coil support 10 by ultrasonic welding.

5. A voice coil arrangement for loudspeakers having a voice coil support (10) and a voice coil (12), which is wound around an outside jacket (14) of the voice coil support (10), characterized in that the voice coil support (10) has a circular groove (11) into which the voice coil (12) is wound to prevent the voice coil (12) from sliding off the voice coil support (10); and the voice coil support (10) and an encircling band (13.1) are made of aluminum and are joined together by ultrasonic welding wherein the encircling band is arranged around the outside jacket (14) of the voice coil support (10) to close off the circular groove (11) for reducing eddy currents.

6. A voice coil arrangement according to claim 5, wherein the voice coil (12) is wound to fill completely the circular groove (11).

7. A voice coil arrangement for loudspeakers having a voice coil support (10) and a voice coil (12), wherein the voice coil arrangement has a circumferential voice coil holding means into which the voice coil (12) is wound to prevent the voice coil (12) from sliding off the voice coil support (10);

wherein the circumferential voice coil holding means and the voice coil support (10) are made from ultrasonically weldable material and wherein the circumferential voice coil holding means comprises:

a circumferential rectangular inwardly bent groove (11) in the voice coil support (10) into which the voice coil (12) is wound to prevent the voice coil (12) from sliding off the voice coil support (10); and an encircling band (13.1) arranged around an outside jacket (14) of the voice coil support (10) to close off the groove (11) for reducing eddy currents, which is at least partially connected to the voice coil support (10) by ultrasonic welding.

8. A voice coil arrangement for loudspeakers having a voice coil support (10) and a voice coil (12), wherein the voice coil arrangement has a circumferential voice coil holding means into which the voice coil (12) is wound to prevent the voice coil (12) from sliding off the voice coil support (10);

wherein the circumferential voice coil holding means and the voice coil support (10) are made from ultrasonically weldable material and the circumferential voice coil holding means and the voice coil support (10) being at least partially connected by ultrasonic welding; and wherein the circumferential voice coil holding means comprises:

a U-shaped holding element (13.2) arranged around and connected to an outside jacket (14) of the voice coil support (10) for enveloping the voice coil (12) to prevent the voice coil (12) from sliding off the voice coil support (10), which is at least partially connected to the voice coil support (10) by ultrasonic welding.

9. A voice coil arrangement for loudspeakers having a voice coil support (10) and a voice coil (12), wherein the voice coil arrangement has a circumferential voice coil holding means into which the voice coil (12) is wound to prevent the voice coil (12) from sliding off the voice coil support (10);

wherein the circumferential voice coil holding means and the voice coil support (10) are made from ultrasonically weldable material and wherein the circumferential voice coil holding means comprises:

a bracket-shaped holding element (13.3) being formed on a free rim (16) of the voice coil support (14) and being bent around and enveloping the voice coil (12) to prevent the voice coil (12) from sliding off the voice coil support (10), which is at least partially connected to the voice coil support (10) by ultrasonic welding.

10. A voice coil arrangement according to claim 9, wherein the bracket-shaped holding element (13.3) has a free end (17) for passing through an opening (19) in the voice coil support (10).

11. A voice coil arrangement for loudspeakers having a voice coil support (10) and a voice coil (12), wherein the voice coil arrangement has a circumferential voice coil holding means into which the voice coil (12) is wound to prevent the voice coil (12) from sliding off the voice coil support (10);

wherein the circumferential voice coil holding means and the voice coil support (10) are made from ultrasonically weldable material and the circumferential voice coil holding means and the voice coil support (10) being at least partially connected by ultrasonic welding; and wherein the circumferential voice coil holding means comprises:

a bracket-shaped holding element (13.4) being connected to an inner sleeve of the voice coil support (10), being bent around and enveloping the voice coil (12) to prevent the voice coil (12) from sliding off the voice coil support (10), having one free end (17) for passing through one opening (19) in the voice coil support (10), and having another free end (17) for passing through another opening (19) in the voice coil support (10).

* * * * *

UNITED STATES PATENT AND TRADEMARK OFFICE

CERTIFICATE OF CORRECTION

PATENT NO. : 5,647,014
DATED : July 8, 1997
INVENTOR(S) : Stefan Geisenberger

It is certified that error appears in the above-identified patent and that said Letters Patent is hereby corrected as shown below:

On title page, item [56],

- Under References Cited, "7/1951" should be --1/1951--
- Under References Cited, "Australia" should be --Austria--;

- Column 4, Claim 7, Line 45, a --;-- should be inserted between "material" and "and";
- Column 5, Claim 9, Line 21, a --;-- should be inserted between "material" and "and".

Signed and Sealed this

Seventeenth Day of March, 1998

Bruce Lehman

*Attest:*

BRUCE LEHMAN

*Attesting Officer*

*Commissioner of Patents and Trademarks*